US007946552B1

(12) United States Patent
St. Claire

(10) Patent No.: US 7,946,552 B1
(45) Date of Patent: May 24, 2011

(54) NOTARY PRIVACY GUARD

(76) Inventor: Sandra St. Claire, Vancouver, WA (US)

( * ) Notice: Subject to any disclaimer, the term of this patent is extended or adjusted under 35 U.S.C. 154(b) by 1283 days.

(21) Appl. No.: 11/231,413

(22) Filed: Sep. 20, 2005

Related U.S. Application Data

(60) Provisional application No. 60/683,104, filed on May 21, 2005.

(51) Int. Cl.
*A47B 19/00* (2006.01)

(52) U.S. Cl. ..... 248/441.1

(58) Field of Classification Search ..... 248/441.1, 248/459, 345.1; 281/20, 28; 462/71; 116/234
See application file for complete search history.

(56) References Cited

U.S. PATENT DOCUMENTS 538,706 A * 5/1895 Sexton ..... 116/234
3,056,215 A 10/1962 Skinner
3,114,552 A 12/1963 Flower
3,861,718 A 1/1975 Strus
5,056,825 A * 10/1991 Templet ..... 283/36
5,069,333 A * 12/1991 Chen ..... 206/39.5
5,212,850 A * 5/1993 Rerolle ..... 24/67 AR
5,237,956 A * 8/1993 Igeta ..... 116/234
6,109,439 A * 8/2000 Goade, Sr. ..... 206/454
6,155,410 A * 12/2000 Davis ..... 206/39.5
6,328,341 B2 * 12/2001 Klure ..... 283/62
6,905,104 B1 6/2005 Offenhauer et al.

* cited by examiner

*Primary Examiner* — Korie Chan
(74) *Attorney, Agent, or Firm* — Rylander & Associates PC; Kurt M. Rylander

(57) ABSTRACT

A notary privacy guard includes a first face substantially opaque having at least four sides, a second face having at least four sides, and a sleeve formed by joining two adjoining sides of the first face with corresponding two adjoining sides of the second face such that the sleeve can slip over two sides and a corner of a book. A second sleeve can be provided to cover both sides of a book. A window can be provided in the substantially opaque face within which the signer can execute his or her signature.

4 Claims, 1 Drawing Sheet

10
11
12
14
16
18
2
20
22
24
26
J

NOTARY PRIVACY GUARD

CROSS-REFERENCE TO RELATED APPLICATION

This application claims priority to provisional application Ser. No. 60/683,104, filed May 21, 2005.

FIELD OF THE INVENTION

This invention relates generally to the field of notary journals or signed registers in which entries are desired to be kept confidential from subsequent signers.

BACKGROUND

A notary public uses a notary journal to record notarized documents. Such is journal entries include the signer's name, address, driver's license information, title of the notarized document(s), and signature. Traditionally, subsequent signers could see all of a previous signer's information. A subsequent signer would then have access to the private information of a previous signer which could allow, at the least, a subsequent signer to breach the privacy of a former signer or, at worst, to commit identity theft.

An existing problem for notary public users occurs when a subsequent signer recognizes a previous signer and takes note of the previous document notarized, which reveals private financial, legal, or confidential information to the third party subsequent signer. Shielding signers from this breach of privacy is therefore desirable.

Previous options to guarding information from subsequent signers included using a new page for each signer, which is wasteful of the notary journal pages and an inefficient use of space. Another option was to use a blank sheet of paper to cover up previous entries but the paper was insecure and could easily slide, fall off, or be moved to reveal the information. Additionally, a blank sheet of paper is often transparent enough to allow the signer to still read the previous entries.

The following represents a list of known related art:

| Reference: | Issued to: | Date of Issue: |
|---|---|---|
| U.S. Pat. No. 6,905,104 B1 | Offenhauer et. al. | Jun. 14, 2005 |
| U.S. Pat. No. 3,861,718 | Strus | Jan. 21, 1975 |
| U.S. Pat. No. 3,114,552 | Flower | Dec. 17, 1963 |
| U.S. Pat. No. 3,056,215 | Skinner | Oct. 2, 1962 |

The teachings of each of the above-listed citations (which does not itself incorporate essential material by reference) are herein incorporated by reference. None of the above inventions and patents, taken either singularly or in combination, is seen to describe the instant invention as claimed.

SUMMARY AND ADVANTAGES

A notary privacy guard is provided to slip over two sides and a corner of a book such as a notary public entry journal. A notary privacy guard includes a first face substantially opaque having at least four sides, a second face having at least four sides, and a sleeve formed by joining two adjoining sides of the first face with corresponding two adjoining sides of the second face such that the sleeve can slip over two sides and a corner of a book. A second sleeve can be provided to cover both sides of a book. A window can be provided in the substantially opaque face within which the signer can execute his or her signature.

The notary privacy guard of the present invention presents numerous advantages, including: (1) protecting information in a page of a notary journal by concealing or obscuring written entries; (2) protecting information on both pages of an open notary journal via one or more sleeves of substantially opaque material; (3) protecting information in a page of a notary journal while leaving space uncovered for a subsequent signer to make a new entry; (4) protecting previous signer's entries while leaving unused spaces uncovered.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

DETAILED DESCRIPTION

Figures 1, 2, 3, 4:
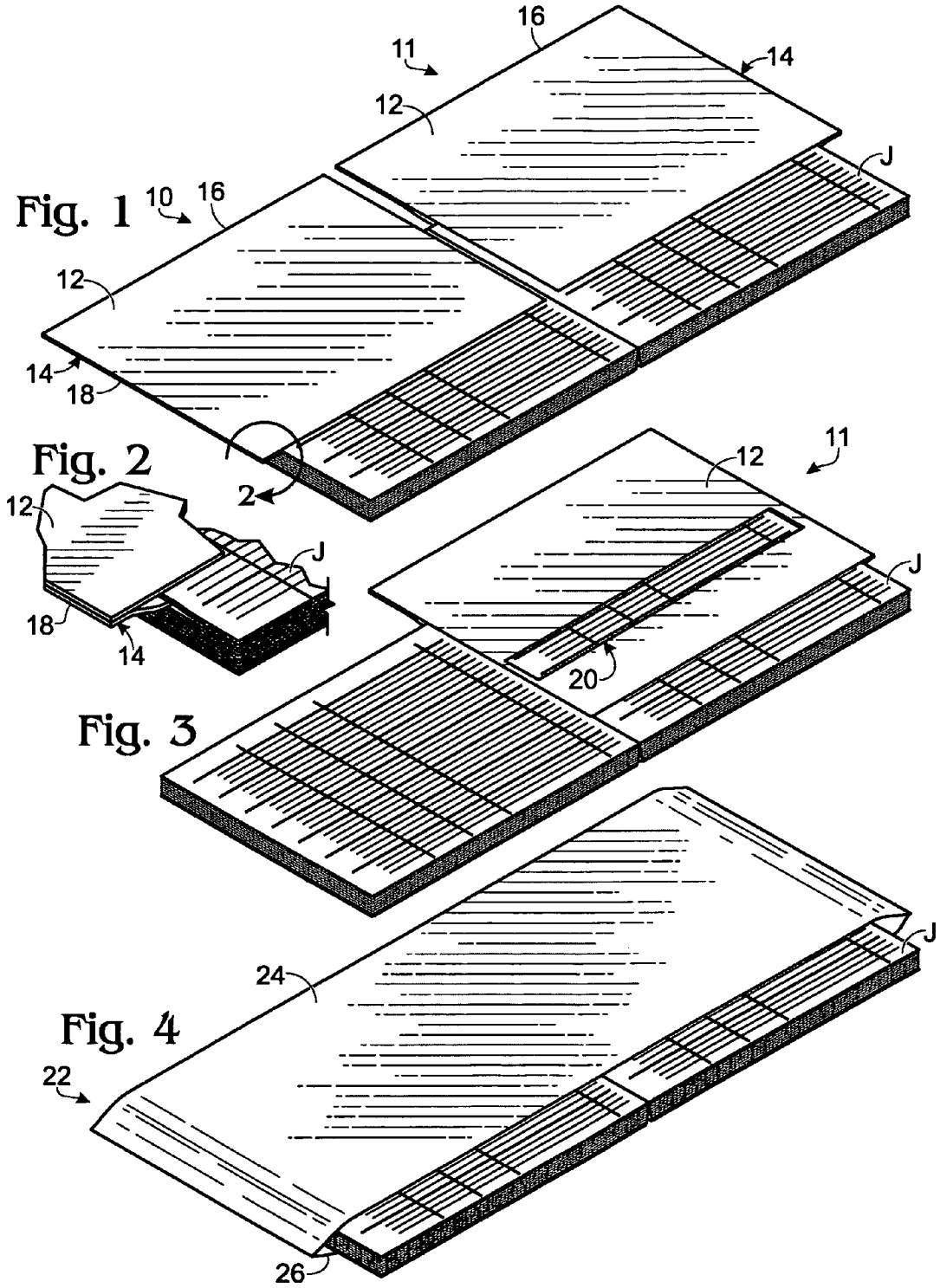
FIG. 1 shows an embodiment of the present invention in use.
FIG. 2 shows a detail of the embodiment of FIG. 1.
FIG. 3 shows another embodiment of the present invention in use.
FIG. 4 shows another embodiment of the present invention in use.

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations is described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

A notary privacy guard is provided to slip a book such as a notary public entry journal to obscure information therein. As shown in FIGS. 1 and 2, a notary privacy guard includes a sleeve 10 having a first face 12 substantially opaque and a second face 14 joined on two adjoining sides. Sleeve 10 is formed by joining the two faces 12, 14 at the top sides and left sides to form a top edge 16 and left side edge 18 of the sleeve 10 such that the sleeve 10 can slip over two sides and a corner of a journal J. The bottom and right sides of the two faces 12, 14 are not joined. Thus, the sleeve 10 can be slid over one-half, the left half or left uppermost page, of the open journal J. Additionally, a second sleeve 11 can be made having the top and right sides of the faces 12, 14 joined leaving the bottom and left sides of the two faces 12, 14 not joined to slip over the right corner and sides of an open journal J. FIG. 2 shows a detailed embodiment of the sleeve 10 from FIG. 1, in which the top face 12 covers the uppermost page of the open journal J. The bottom face 14 is underneath any number of journal pages. In the preferred embodiment sleeve 10 is rectangular, so as to fit over the page of a typical notary journal, register, or book and is constructed of substantially opaque or translucent material which is opaque enough to obscure the writing, symbols or drawing underneath, and substantially flat material. Those of skill in the art know that if the book to be covered is not quadrilateral then the sleeves may be formed to fit whatever the shape of the journal.

In operation in the embodiment shown in FIG. 1, at least the top face 12 of the sleeve 10 is made of a substantially opaque material, which selectively obscures the writing on the uppermost page of an open journal J when the sleeve 10 is in place. As more entries are made, the sleeve 10 may be slid further down the journal J to cover these entries but leaving uncovered space for subsequent signers. When the journal page is full and no more entries can be made, the sleeve 10 can be moved all the way to the bottom of the journal page J, thus obscuring the entire page's writing. As shown in FIG. 1, when two sleeves 10, 11 are used to cover both sides of the open journal J, both may be slid down simultaneously to cover an entry executed on both pages.

In another embodiment, as shown in FIG. 3, a transparent window 20 is located within the substantially opaque top face 12 such that a person could read or write on the journal page J. The window 20 reveals a portion of the left uppermost page of the open journal J. The window 20 is a hole, preferably rectangular, in the top face 12 of the sleeve. As more entries are made, the sleeve 11 may be slid further down the journal J to cover these entries while the window 20 is aligned with the space for the new entry on the journal page. When two sleeves 10, 11 are used to cover both sides of the open journal J, both may be slid down simultaneously to cover previous entries executed on both pages.

In another embodiment, as shown in FIG. 4, a notary privacy guard is a sleeve 22 having a first face 24 substantially opaque having at least four edges, a second face 26 having at least four edges, joined on three adjoining sides. Sleeve 22 is formed by joining three adjoining sides of the first face 24 with the corresponding three adjoining sides of the second face 26 such that the sleeve 22 can slip over three sides and two corners of a journal J. The bottom face 26 is entirely underneath the open notary journal J. The top face 24 covers the uppermost journal pages. Thus, a sleeve 22 is formed that can slide over three sides and two corners of an open journal J. Hence, the sleeve 22 can be slid over both the right half and the left half of the open journal J. As more entries are made, the sleeve 22 may be slid further down the journal J to cover these entries but leaving uncovered space for subsequent signers. When the journal page is full and no more entries can be made, the sleeve 22 can be moved all the way to the bottom of the journal page J, thus obscuring the writing on both pages.

In any of the embodiments, the top faces 12, 24 of the sleeves 10, 11, 22 may contain indicia such as directions to signers as to where to sign or fill in other information such as name and address, and a notice that the sleeve protects signer's privacy. Such indicia could also include the headings of the notary journal sections which are obscured by the sleeves.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. A notary privacy guard, comprising:

A first face substantially opaque having at least four sides;

A second face having at least four sides; and

A sleeve formed by joining two adjoining sides of the first face with corresponding two adjoining sides of the second face into which two sides and a corner of a book can be slipped while leaving the bottom and right sides of the two faces unjoined wherein the sleeve can slip over two sides and a corner of a book to selectively cover any portion of the open journal.

2. A notary privacy guard, comprising:

a substantially flat sleeve, having at least two broad faces joined on at least two adjacent sides, and at least one face of the sleeve being substantially opaque while leaving the bottom and right sides of the two faces unjoined, wherein the sleeve can slip over two sides and a corner of a journal to selectively cover any amount of the open journal.

3. The notary privacy guard of claim 1, further comprising a second sleeve so that both pages of an open journal or book may be covered.

4. The notary privacy guard of claim 2, further comprising a second sleeve so that both pages of an open journal or book may be covered.

* * * * *